United States Patent [19]

Setterberg, Jr.

[11] 4,388,970

[45] Jun. 21, 1983

[54] APPARATUS AND METHOD FOR CONTROLLING INJECTION FLUID FLOW IN A WELL ANNULUS

[75] Inventor: John R. Setterberg, Jr., Richardson, Tex.

[73] Assignee: Otis Engineering Corporation, Dallas, Tex.

[21] Appl. No.: 236,144

[22] Filed: Feb. 20, 1981

[51] Int. Cl.[3] ..... E21B 23/00

[52] U.S. Cl. ..... 166/382; 166/188; 166/133

[58] Field of Search ..... 166/382, 386, 387, 188, 166/325, 326, 133, 206, 208, 131, 132

[56] References Cited

U.S. PATENT DOCUMENTS

| | | | |
|---|---|---|---|
| 1,690,536 | 11/1928 | Hartman | 166/132 |
| 1,896,482 | 2/1933 | Crowell | 166/131 |
| 2,507,262 | 5/1950 | McGivern | 166/131 |
| 3,847,223 | 11/1974 | Scott et al. | 166/188 |
| 4,093,030 | 6/1978 | Bonds | 166/382 |

*Primary Examiner*—Ernest R. Purser
*Assistant Examiner*—Thuy M. Bui
*Attorney, Agent, or Firm*—H. Mathews Garland; Peter J. Murphy

[57] ABSTRACT

A tubular member, to be a segment of the casing string, is provided with a polished bore at its upper end and a locking profile at its lower end. The locking profile includes a bearing shoulder and internal left hand threads for coaction with a latching mechanism. Another tubular member, to be a segment of the production tubing, has groups of circumferentially separated flutes to (1) maintain concentricity of the tubing segment, (2) provide axial flow passages between the segments, and (3) provide support for components of the tubing segment. A tubular packing mandrel, mounted on flutes, carries external annular packing for sealing engagement with the polished bore. The lower end of the packing mandrel defines an annular valve seat; and a tubular valve closure member, mounted in sliding, sealing relation on the tubing segment, has a coacting upward facing valve seat. A valve spring urges closure of the valve closure member. Lower flutes define a bearing shoulder for coaction with the casing shoulder to support the tubing string. A latching mechanism includes circumferentially separated axially extending spring fingers carrying external threads for coacting ratcheting and threaded engagement with the profile threads. When the tubing string is lowered to the support position provided by the bearing shoulders, the tubing segment is locked within the casing segment.

16 Claims, 16 Drawing Figures

APPARATUS AND METHOD FOR CONTROLLING INJECTION FLUID FLOW IN A WELL ANNULUS

This invention relates to controlling the flow of injection fluid into a well through the annulus between the casing string and the production tubing string; and more particularly to an apparatus and method for performing that and other functions.

In many producing oil wells the production fluid contains very corrosive constituents such as hydrogen sulfide and carbon dioxide which, if not controlled, shorten very drastically the lives of the in-hole components of the well, particularly the string of production tubing. One way to reduce the effect of this problem is to use tubing and other components which have been particularly designed to resist the effect of such corrosion. The components may be fabricated from corrosion-resistant materials, or they may be treated metallurgically to resist corrosion, or they may be simply fabricated from heavier materials to resist the effects of corrosion for a longer time. Often such specifically designed components are more expensive. An other way to attack the problem is to inject into the well corrosion-inhibiting chemicals to protect the component surfaces which define the injection passage, and which will mix with the production fluid to neutralize the corrosiveness of the production fluid and, therefore, protect the component surfaces contacted by the production fluid, principally the bore of the production tubing.

Occasionally it is necessary to kill a producing well by injecting through the annulus a heavy fluid or kill mud to fill the annulus and production tubing to the extent necessary to overcome the well pressure; and at a later time the kill mud is displaced through the injection of a light fluid. Since this kill mud flows through the same passages and components as the above discussed injection fluid, it is desirable that the flow control components for the injection fluid withstand the flow of kill mud, and continue to perform the injection fluid control function when the well is returned to production.

A principal object of this invention is to provide an apparatus and method for the one-way valving of injection fluid in the annulus between the well casing and production tubing.

Another object of this invention is to provide an apparatus and method for such valving, and additionally for shutting in the annulus against the well pressure.

A further object of this invention is to provide an apparatus and method for such valving, and additionally for hanging the tubing string within the well casing.

Still another object of this invention is to provide an apparatus and method for such valving, and additionally for locking the tubing string against axial movement in either direction within the well casing.

A still further object of this invention is to provide an apparatus and method for such valving, and additionally for releasably locking the tubing string against upward movement within the casing.

Another object of this invention is to provide an apparatus and method for such valving wherein the valve mechanism is extremely durable providing long life under adverse operation conditions such as flow of abrasive fluid.

These objects are accomplished in apparatus which includes, broadly, a tool housing to be run into the well and a coacting tool mandrel to be run into the casing. The tool housing comprises a tubular member having a polished bore in one portion and having an internal locking profile. The tool mandrel comprises a tubular member having external longitudinally spaced spacer members to provide axial flow paths between the tool housing and tool mandrel. A tubular packing mandrel is mounted on the spacer members, and carries external annular packing means for sealing engagement with the polished bore of the tool housing. The packing mandrel has means at one end defining an annular valve seat. A tubular valve closure member is mounted for axial sliding movement on the tool mandrel, and has means at one end defining an annular valve closure for coacting sealing engagement with the valve seat. The closure member carries internal annular packing means for sealing engagement with the tool mandrel. A locking means is mounted on the tool mandrel for coacting engagement with the locking profile to limit axial movement of the tool mandrel relative to the tool housing.

These objects are also accomplished by a method which includes, broadly, the steps: the running into the well a tubular tool housing having an interior polished bore and having an interior locking profile; running into the well casing, as a segment of the production tubing, a tubular tool mandrel provided with external longitudinally spaced spacer members; mounting on said spacer members, a tubular packing mandrel for sealing engagement with the polished bore of the tool housing; providing, on one end of the packing mandrel, means defining an annular valve seat; mounting, in slidable relation on said tool mandrel, a tubular valve closure member provided at one end with means defining a valve closure for sealing engagement with the valve seat; and mounting, on said tool mandrel, locking means for coacting engagement with the locking profile, to limit axial movement of the tool mandrel relative to the tool housing.

The novel features and advantages of the invention, as well as additional objects thereof, will be understood more fully from the following description when read in connection with the accompanying drawings.

DRAWINGS

Figure 2A:
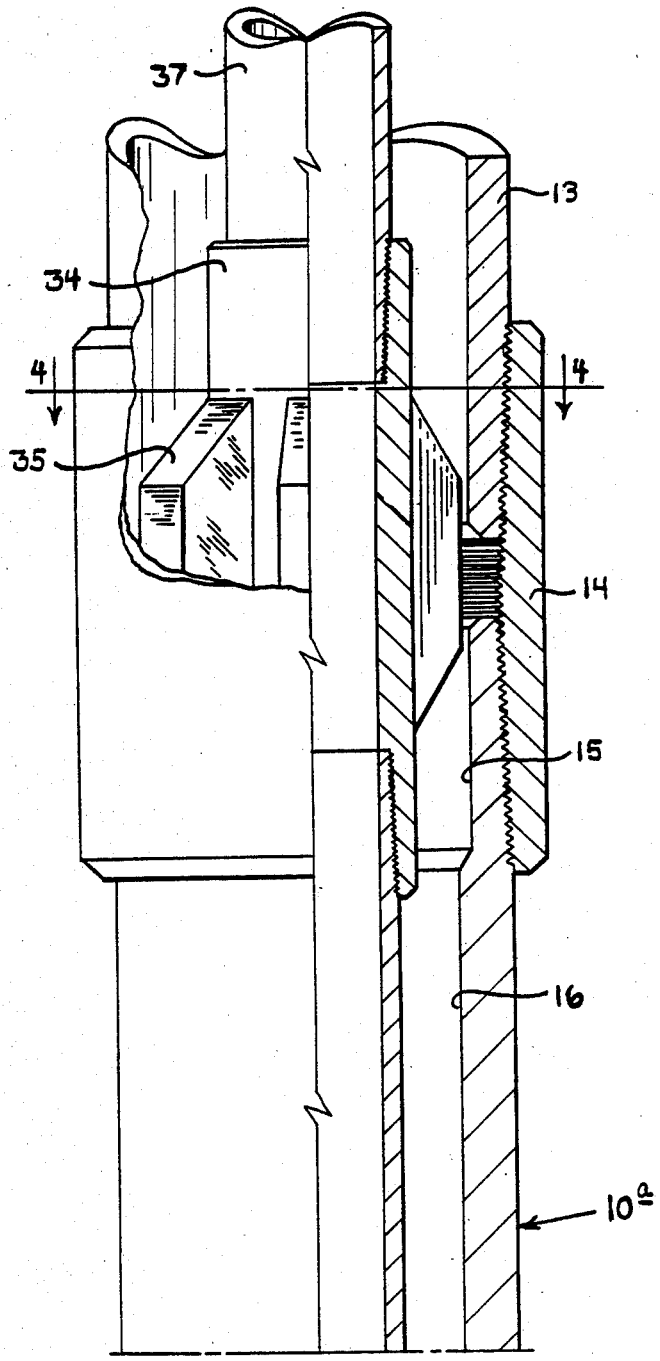
FIGS. 2A through 2E are sequential sectional and/or elevation views of the assembly of FIG. 1, showing details of the several components.
Figure 2B:
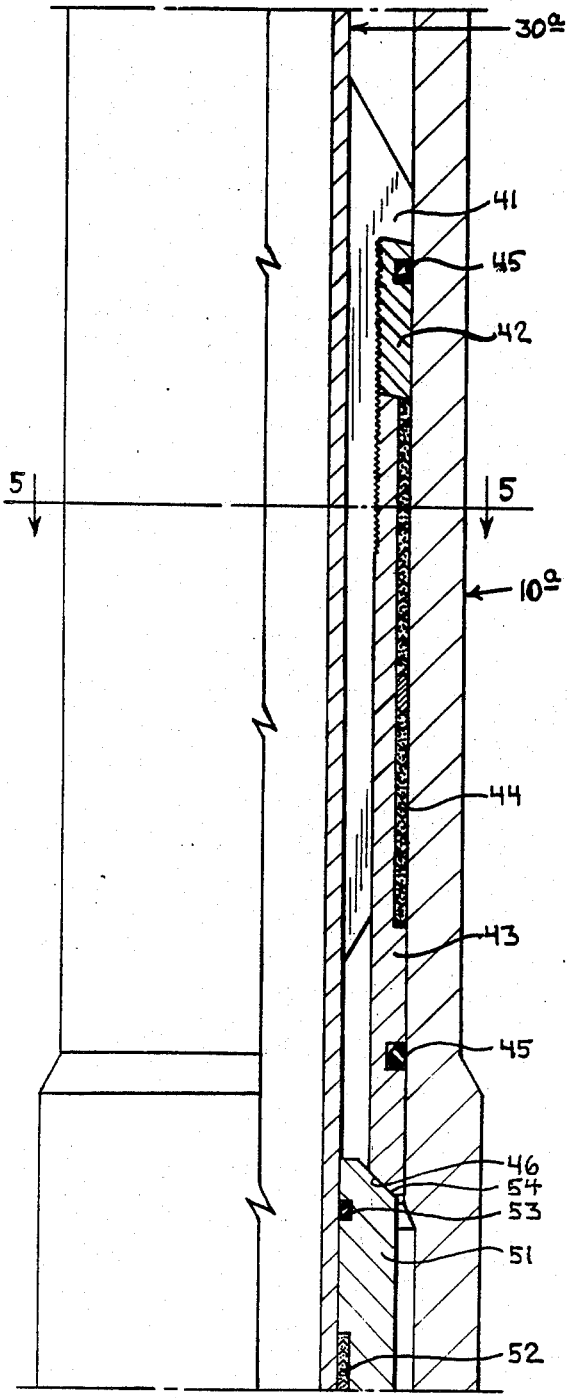
Figure 2C:
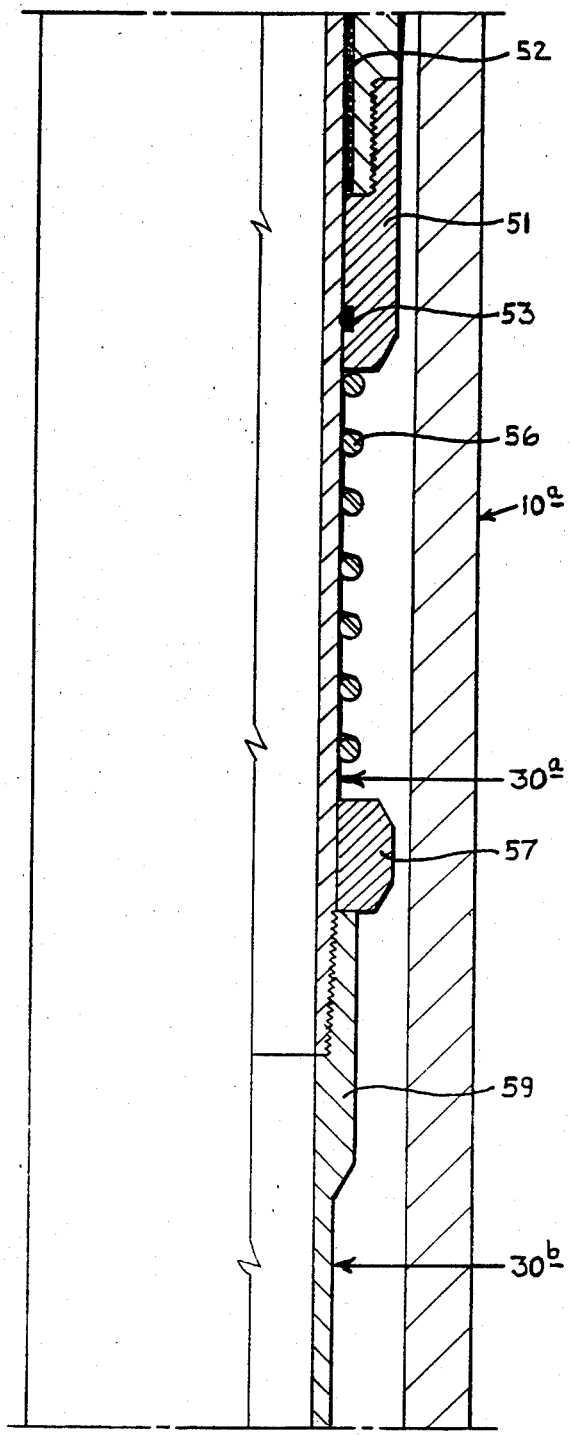
Figure 2D:
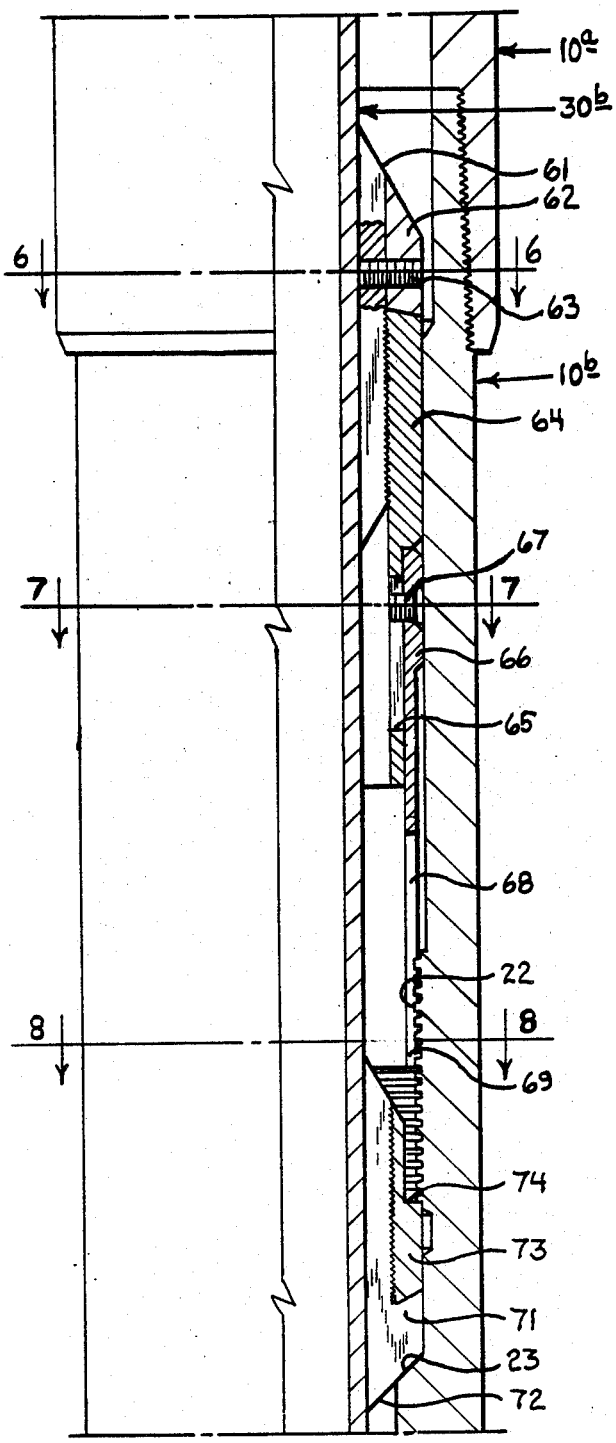
Figure 3:
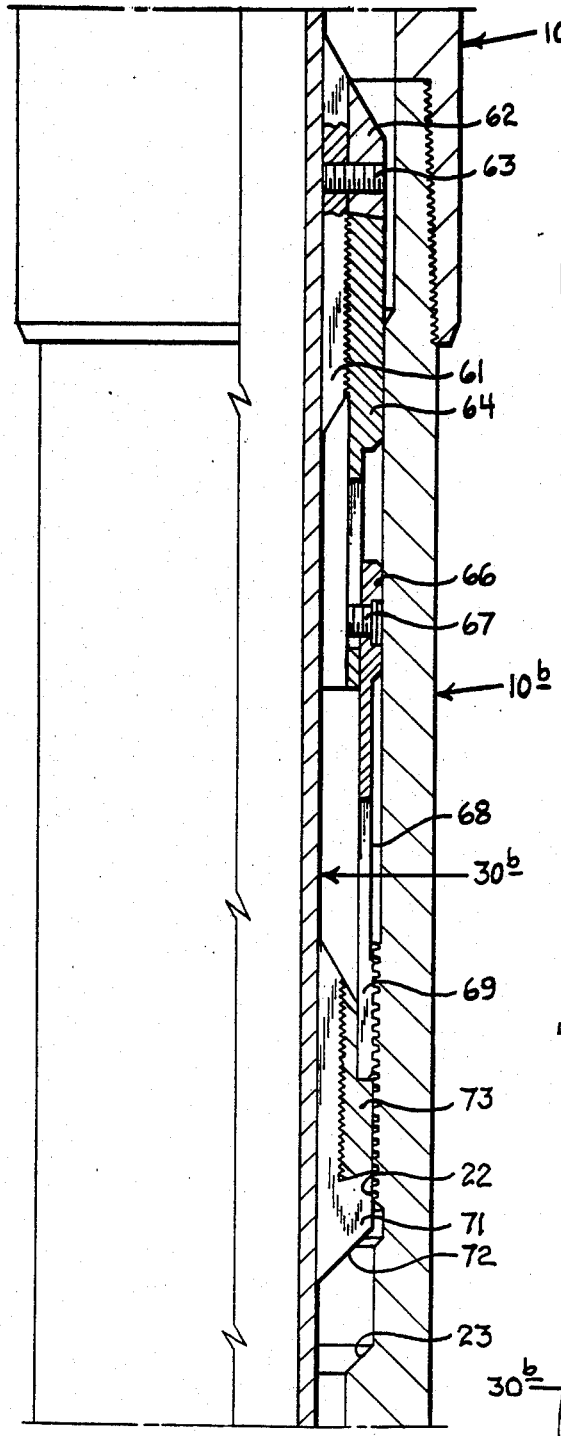
FIG. 3 is a fragmentary sectional and elevation view, corresponding to a FIG. 2D, illustrating a different condition of that portion of the assembly.
Figure 4:
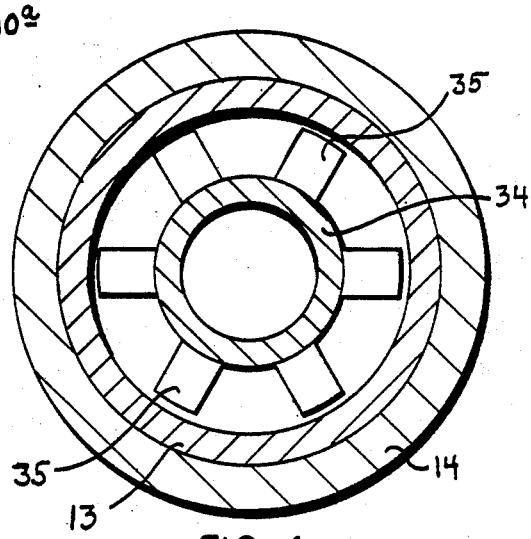
Figure 5:
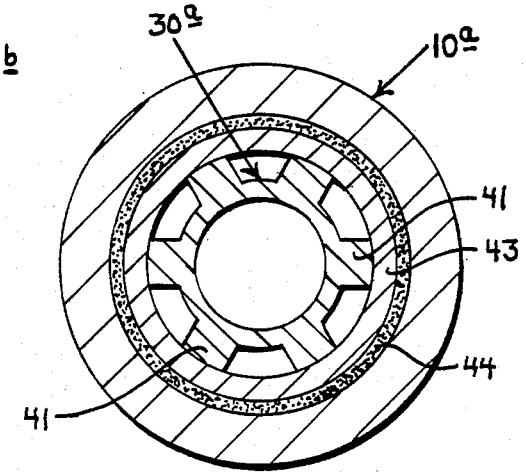
Figure 6:
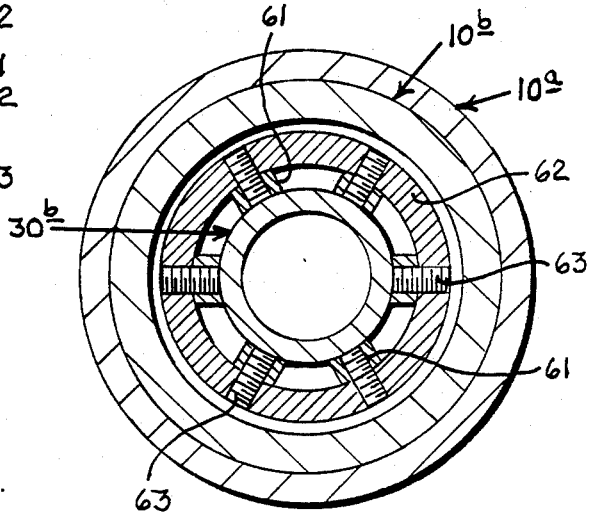
Figure 7:
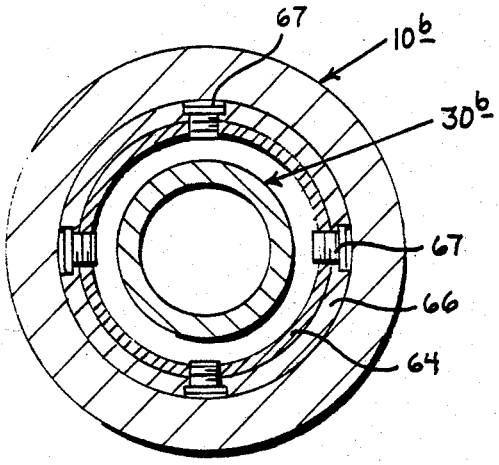
Figure 8:
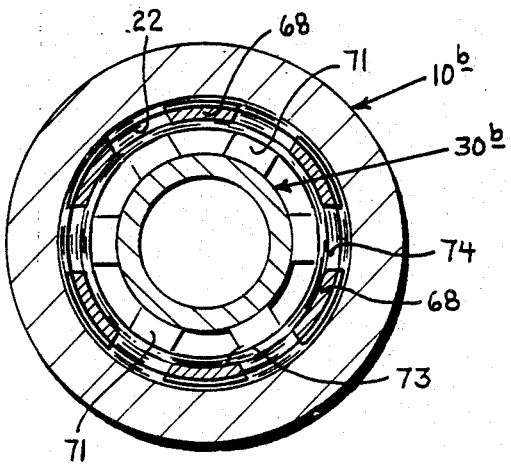
Figure 9:
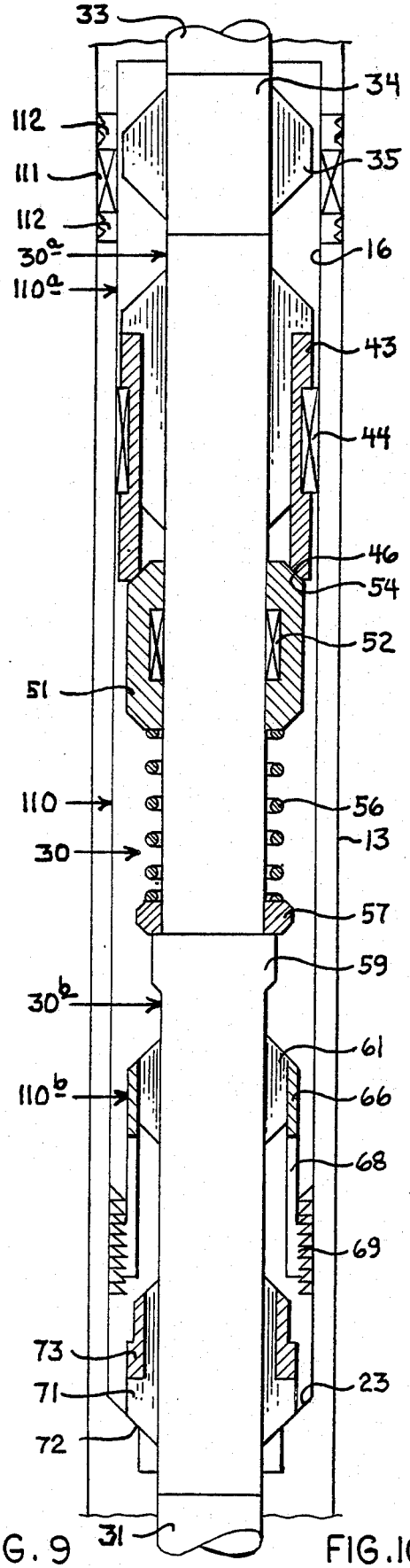
Figure 10:
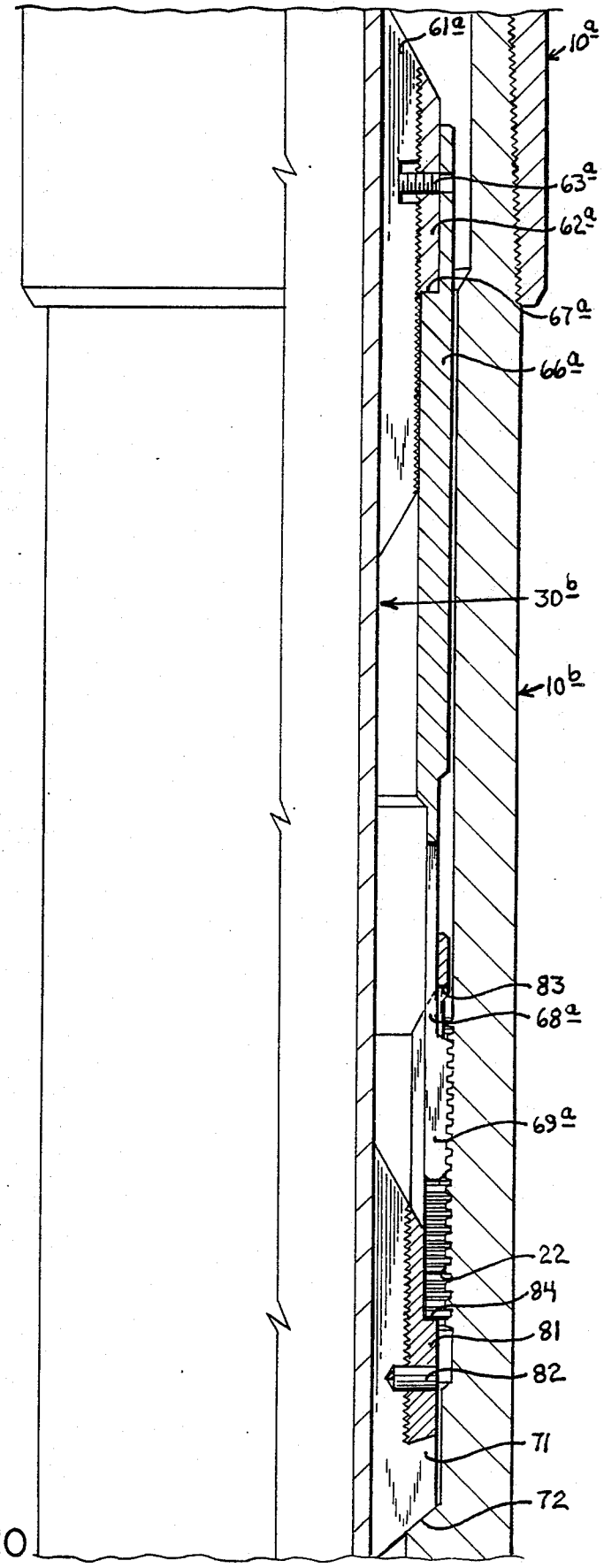
Figures 11, 12:
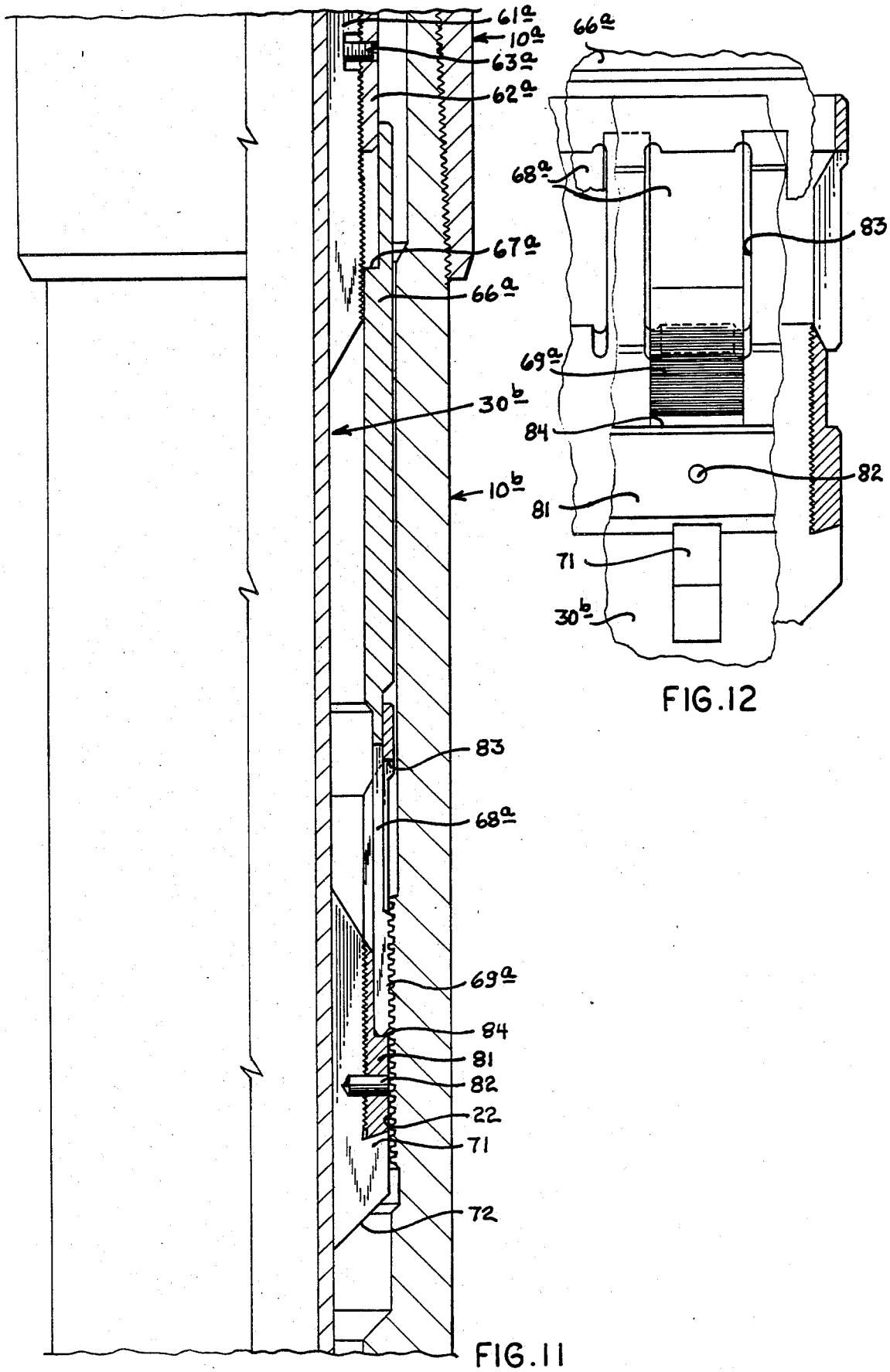

FIGS. 4, 5, 6, 7, and 8 are sectional views taken along the lines 4—4, 5—5, 6—6, 7—7, and 8—8 of FIGS. 2A through 2D respectively;

FIG. 9 is a diagrammatic illustration of an alternative form of assembly according to the invention, with the tubing string suspended by the assembly;

FIG. 10 is a fragmentary sectional and elevation view, which is a counterpart of FIG. 2D, illustrating alternative structure for that portion of the assembly;

FIG. 11 is a fragmentary sectional and elevation view, which is a counterpart of FIG. 3, illustrating a different condition of the portion of the assembly illustrated in FIG. 10;

FIG. 12 is a fragmentary elevation view of a portion of tool mandrel locking mechanism, in the condition illustrated in FIG. 11.

DESCRIPTION OF THE PREFERRED EMBODIMENTS

Figure 1:
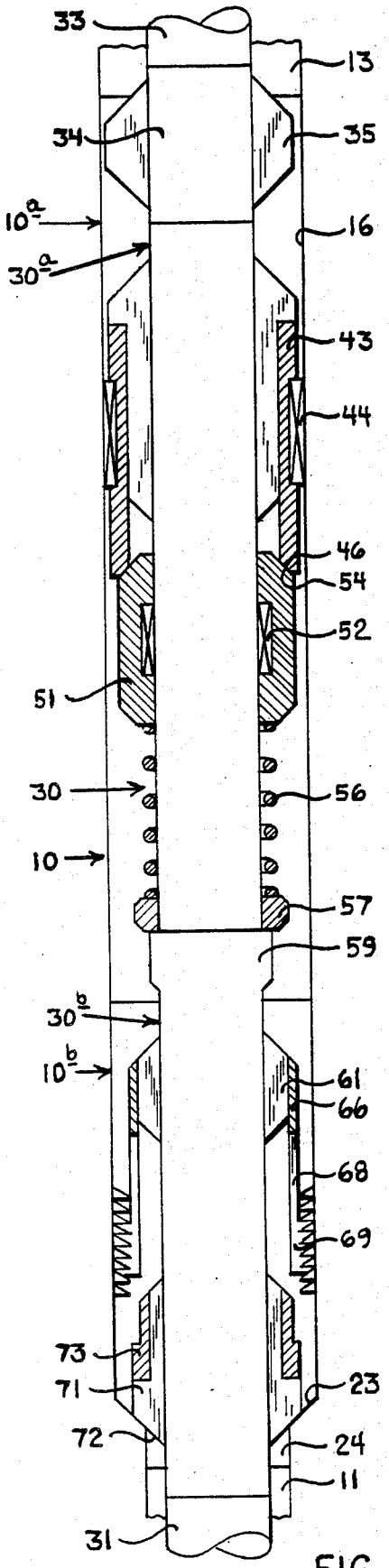
FIG. 1 is a diagrammatic illustration of an assembly according to the invention, with the tubing string suspended by the assembly.

FIG. 1 illustrates diagrammatically one form of apparatus according to the invention, with the apparatus functioning as a tubing hanger. In this connection the tool mandrel, and the production tubing to which it is attached, are suspended by the tool housing and the casing string to which it is attached. FIGS. 2A through 2E of the drawing illustrate the apparatus in the same condition; and FIG. 3 of the drawing illustrates the apparatus in the condition where it functions to shut in the well pressure and also to prevent the tubing string from being raised within the well casing by the force exerted by the well pressure.

With reference to the diagrammatic FIG. 1, the components and structural features of the apparatus will be identified. As illustrated in the drawing, the apparatus functions as a crossover between two sizes of casing in a tapered casing string, such as a crossover between 7 inch and 5 inch casing. By way of example, such a crossover point may occur at a depth of about 12000 feet in a 20000 foot well.

The basic components of the apparatus are a tool housing incorporated as a casing segment 10 which is run into the well with the casing string, and a tool mandrel incorporated as tubing segment 30 which is run into the casing with the tubing string. While each of these segments may be unitary members, in the illustrated form the casing segment 10 consists of an upper portion 10*a* and a lower portion 10*b* and similarly this tubing segment 30 consists of an upper portion 30*a* and a lower portion 30*b*. In the illustrated form, these segments are made in two separate parts to facilitate the machining of these parts and for other reasons which will be discussed. The lower end of the casing segment is coupled to a section 11 of the smaller casing string, 5 inch casing for example; and this casing string may extend to the production zone of the well and provided with perforations 9 to enable flow of the production fluid into the well. A section of larger casing 13, 7 inch casing for example, is connected to the upper end of the casing segment, and is a part of the casing string extending upward toward the wellhead.

Referring now to the structural features which appear in diagrammatic FIG. 1, the upper casing segment portion 10*a* might be referred to as a polished bore receptacle; and a portion of the bore is a polished bore 16 for coaction with the packing to be described. The lower casing segment portion 10*b* might be referred to as a locking receptacle; and the bore of this locking receptacle includes a locking profile which consists of a length of internal threads 22 and an upward facing bearing shoulder 23. The lower end of this receptacle includes a reduced diameter portion 24, dimensioned for coupling to the smaller casing string 11.

The tubing segment 30 is coupled to a section of tubing 31 by a suitable coupling 32; the tubing section 31 being a part of the tubing string which extends downward to the production zone of the well. A tubing section 33 which is a part of the following tubing string is coupled to the tubing segment by means of a centralizer sub 34 which is a part of the tubing segment. The centralizer sub includes circumferentially spaced flutes 35 which coact with the casing segment to maintain concentricity of the two segments at the upper end.

An additional array of circumferentially spaced centralizing flutes 41 are provided on the upper portion 10A of the tubing segment intermediate its ends. In addition to performing a centralizing function these flutes provide the mounting for a packing mandrel 43 which carries an external annular packing 44 for sealing engagement with the polished bore 16 of the casing segment. This packing mandrel is rigidly fixed to the tubing segment, as will be described, and the lower end face of the packing mandrel is provided with a conoid end face 46 which defines a valve seat. A tubular valve closure member 51 is slidably mounted on the tubing segment and carries an internal annular packing 52 in sealing engagement with the tubing segment. The upper end face of this closure member includes a conoid surface 54 which defines a closure seat for coacting sealing engagement with the valve seat 46. The closure member 51 is normally urged into that sealing engagement by a helical valve closure spring 56 which surrounds the tubing segment and is compressed between the lower end face of the closure member and a bearing ring 57. The bearing ring is disposed at the lower end of the upper tubing segment portion 30*a* which includes a threaded pin coupled to a threaded box 59 of the lower portion 30*b*; and this threaded box provides a shoulder for limiting downward movement of the bearing ring 57.

The above described flutes 35 and 41, in addition to providing a centralizing function, also provide axial flow paths between the casing and tubing segments; and both of these functions are also provided by the flutes on the lower segment portion 30*b* described below. Upper flutes 61 provide a mounting for a tubular latch 66 which includes circumferentially spaced downwardly extending spring fingers 68. These spring fingers are provided with external serrations 69 at their distal ends, which serrations define external threads of the tubing segment for coaction with the internal threads 22 of the casing segment. These fingers then define a latch which is engageable with the casing threads by a ratcheting action responsive to downward movement of the tubing segment relative to the casing segment. As will be described, this latch may be disengaged by relative rotation of the segments. Lower circumferentially spaced flutes 71 are provided adjacent to the lower end of the segment portion 30*b*, and the downward facing conoid surfaces of these flutes define a bearing shoulder 72 which coacts with the bearing shoulder 23 of the casing segment; and through the coaction of these shoulders the casing segment defines a tubing hanger. These lower flutes support an annular locking cap 73 which functions to lock the spring fingers 68 of the latch 66 as will be described subsequently.

FIGS. 2 through 8 of the drawing illustrate the abovedescribed apparatus in detail, and the following is a detailed discussion of certain of the components and structural features referred to above.

As best seen in FIGS. 2A and 2B, the smallest diameter bore of the casing portion 10*a* is disposed adjacent to the upper end of that portion and is the polished bore 16 for coaction with the packing of the tubing segment 30. An enlarged bore 15 is provided at the upper end of this casing portion; and the internal diameter of this enlarged bore corresponds to the internal diameter of the casing string 13. The polished bore then has a relatively smaller diameter. The flutes 35 of the centralizer sub 34 are dimensioned to provide an outer diameter larger than that of the polished bore 16, the purpose being to centralize the tubing sub as it is run downward within the casing and maintain the packing 44 out of engagement with the casing walls to protect that packing from damage due to abrasion.

Referring now to the packing structure best seen in FIG. 2B, the upper ends of the flutes 41 have a maximum diameter to perform the centralizing function, and these flutes are undercut to provide a reduced diameter along the remainder of their lengths. These flutes are threaded adjacent to their upper end and adjacent to the undercut to receive an internally threaded tubular packing cap 42 and also to receive the internally threaded upper end of the tubular packing mandrel 43. The upper portion of the external face of the packing mandrel is recessed to accommodate a substantial length of the annular packing 44 which is confined at its upper end by the packing cap 42. Trash wiper o-rings 45 are provided in the cap 42 and the packing mandrel 43.

Referring now to the valve structure best seen in FIGS. 2B and 2C, the lower end of the packing mandrel is provided with a finished conoid end face to provide a fixed valve seat for the tubing segment. The tubular valve closure member 51 is dimensioned for a close sliding relation with the tubing segment portion 30*a*, and consists of upper and lower portions to define an accessible internal annular recess for the annular packing 52. The closure member carries upper and lower trash wiping o-rings 53 adjacent to the opposite ends. The upper end of the closure member is provided with an upward facing conoid face configured to define a closure valve seat 54 which coacts with the fixed valve seat 46.

By way of example, where the valve is designed to allow the passage of heavy fluids such as kill mud which may contain abrasive materials, these valve seats are appropriately finished to provide surfaces which will resist cutting by abrasive fluids. For example, the seats may be treated with a material to produce approximately a 71RC hardness, with the seats then being round and lapped. It will be understood that the apparatus of the invention might include other configurations of coacting fixed and closure valve seats.

Referring now to the locking structure and mechanism, best seen in FIG. 2D, this locking structure functions to limit axial movement of the tubing segment and its associated tubing string in either direction relative to the casing segment and the associated casing string. One aspect of this locking structure is the conoid bearing shoulder 23 of the locking receptacle 10*b* which coacts with the support shoulder 72 of the tubing segment defined by the flutes 71. The bearing shoulder 23 then functions as a tubing hanger and, of course, limits downward movement of the tubing string relative to the casing string. The lower end 24 of the casing segment is of reduced diameter, both externally and internally, to correspond to dimension to the smaller diameter casing 11 to which it is joined by means of a coupling 12. Adjacent to the lower end of the locking receptacle, the diameter enlarges to define the bearing shoulder 23 and, intermediate the ends of receptacle, the inner wall is provided with a length of internal threads 22 such as buttress threads which are a part of the latch mechanism to be described. The bearing shoulder 23 and the threads 22 together define a locking profile in the casing segment which coacts with structure of the tubing segment to limit movement of the tubing segment in either direction relative to the casing segment.

A suitable latching mechanism which is illustrated and described is a form of the Otis Ratch Latch manufactured by Otis Engineering Corporation of Dallas, Texas. As best seen in FIG. 2D, the tubing segment portion of this latch mechanism is mounted on the reduced diameter flutes 61 which define an upper internal cylindrical surface for supporting an annular retainer cap 62, and a lower threaded surface to which is secured a tubular latch guide 64 internally threaded at its upper end. The retainer cap 62 is secured to the flutes 61 by means of set screws 63; and the latch guide 64 is threaded onto the flutes to the limit fixed by the retainer cap. The lower distal end of the tubular latch guide 64 is provided with four axially elongated slots 65, and with a downward facing shoulder 65*a* immediately above the slots. The upper end of the tubular latch 66 is dimensioned for axial sliding movement relative to the lower slotted end of the latch guide 64 limited by the shoulder 65*a*, and is secured to the latch guide by means of key pins 67 threaded through the latch and projecting into the slots 65. With this mounting arrangement the latch 66 is secured against rotation relative to the latch guide 64 and the tubing 30*b* but is mounted for limited relative axial movement, which movement might be 2 inches for example. The distal end of the tubular latch consists of the circumferentially spaced spring fingers 68 provided at their distal ends with external serrations 69 which define threads such as buttress threads for mating threaded engagement with the casing segment threads 22. The type of threads, such as buttress threads, are selected to facilitate the engagement of the latch mechanism by ratcheting and also to perform the function of preventing upward movement of the latch fingers relative to the casing threads.

The upper portions of the lower flutes 71 are recessed and provided with external threads for the mounting of an internally threaded annular locking cap 73. The locking cap 73 is provided with an external upper recess defining an upward facing shoulder 74. The function of this locking cap is best seen in FIG. 3. It will be seen that the well pressure which is transmitted upward through the annulus between the casing and tubing acts on the lower face of the valve closure member 51 to produce a force tending to lift the tubing string relative to the casing string. This force is normally exceeded by the downward forces produced by the weight of the tubing string and also produced by the injection pressure acting on the upper exposed face of the valve closure member 51. However, should the force produced by the well pressure exceed the opposing forces, the tubing string and tubing segment will move upware slightly from the relative positions illustrated in FIGS. 1 and 2A to 2E and, as best seen in FIG. 3, the flutes 71 and associated locking cap 73 will move upward from the tube hanging position seen in FIG. 2D to the position shown in FIG. 3. With this movement the recess of the locking cap moves within the distal ends of the spring fingers; and the parts are dimensioned that the spring fingers cannot disengage from the casing threads 22. The locking cap shoulder 74 bears on the ends of the spring fingers to prevent further upward movement of the tubing string relative to the casing string.

It will be noted that this relative movement of the tubing segment relative to the spring fingers 68 is allowed by the mounting of the latch 66 on the latch guide 64. During engagement of the latch mechanism, when the tubing segment is moving downward relative to the casing segment, the distal ends of the spring fingers first engage the threads 22, and with the resistance to ratcheting engagement resulting from the biasing of the spring fingers, the downward movement of the latch will be stopped, and continued movement of the latch carrier effects the relative movement of the key pins 67 to the upper ends of the slots 65; and with this relative movement the distal ends of the fingers are moved to clear the locking cap 73. When the upper end of the latch 66 engages the latch guide shoulder 65*a*, the latch again moves downward relative to the casing segment to effect ratcheting engagement of the spring fingers, and this further movement is limited by the engagement of the bearing shoulders 72 and 23. In the tube hanging condition then, the pins 67 are disposed adjacent to the upper ends of the slots 65 to allow for the subsequent upward movement of the tubing string resulting from excessive well pressure.

Embodiment of FIG. 9

FIG. 9 is a diagrammatic view similar to FIG. 1, and illustrates the assembly of FIG. 1 with the exception that the tool housing is not a segment of the casing 13. Referring to this Figure, it will be seen that the tool housing 110 consists of upper and lower portions 110*a* and 110*b*, but that the tool housing is independent of the casing 13. In other respects, the assembly is identical to that of FIG. 1. For this embodiment, the tool housing 110 is lowered into the casing 13 and is secured at a selected depth in the well within the casing by means of a packer 111 having suitable slips 112 for securely locking the tool housing and preventing any axial movement of the tool housing relative to the casing.

Embodiment of FIGS. 10 through 12

FIGS. 10 through 12 illustrate a modified form of locking mechanism mounted on the tool mandrel 30*b* for coaction with the locking profile of the lower housing portion 10*b*. FIG. 10 is a counterpart of FIG. 2D and illustrates that same portion of the overall assembly which is illustrated in FIG. 2D; and FIG. 11 is a counterpart of FIG. 3 illustrating this particular portion of the assembly in the alternative condition described with respect to FIG. 3. In describing the structure of FIGS. 10 and 11, the same reference numbers will be used for the identical parts, and the same reference numbers with the subscript "a" will be used for counterparts which are modified.

Referring particularly to FIG. 10, the housing portion 10*b* and its associated internal threads 22 and bearing shoulder 23 are identical to that described in FIG. 2D. The lower portion 30*b* of the tool mandrel is provided with upper flutes 61*a* and lower flutes 71 which, in addition to their spacing functions, support the locking mechanism in a manner somewhat different than that described with respect to FIGS. 2D and 3.

The peripheries of the flutes 61*a* are provided with external threads; and an annular retainer cap 62*a* is internally threaded to be secured to these flutes, and locked against rotation on the flutes by set screws 63*a*. This retainer cap defines a stop for limiting upward movement of the latch 66*a* as will be described.

The latch 66*a* is a tubular member having a skirt portion at its upper end which overlies the exterior face of the retainer cap 62*a*, this skirt defining an upward facing shoulder 67*a* which confronts the lower face of the retainer cap 62*a* to limit relative movement of these members. The latch 66*a* includes a downwardly extending circumferentially spaced spring fingers 68*a* which are provided at their distal ends with external serrations defining threads for mating threaded and ratcheting engagement with the profile threads 22 of the tool housing 10*b*.

The latch 66*a* is rotationally keyed to the tool mandrel by means of a locking sleeve 81, internally threaded at its lower end for threaded engagement with the upper externally threaded portion of the flutes 71. This locking sleeve is threaded down to seat on lower lips provided by the flutes 71, and is locked against rotation relative to the flutes by suitable locking pins 82. This threaded joint is by means of left-hand threads to prevent unthreading of the joint with left-hand rotation of the tool mandrel for a purpose to be described. Adjacent to its upper end, the locking sleeve is provided with elongated, circumferentially spaced windows 83 having widths larger than the width of the respective spring fingers 68*a*; and the locking sleeve is configured to allow the spring fingers to lie inside the sleeve, but to be disposed outside a portion of the sleeve in the position illustrated in FIGS. 11 and 12. The sleeve is provided with an upward facing external shoulder 84 for engagement with the lower ends of the spring fingers 68*a* to limit relative axial movement of these members.

Referring now to the operation of this mechanism, when the tool mandrel 30 is being lowered into the tool housing 10, and the latch 66*a* encounters resistance when the serrated ends 69*a* of the spring fingers first engage the housing threads 22, the downward movement of the latch will stop until the lower face of the retainer cap 62*a* engages the shoulder 67*a* of the latch. The latch 66*a* will then again move with the tool mandrel to effect ratcheting engagement of the serrations 69*a* with the threads 22 and this will continue until the bearing shoulder 72 of the tool mandrel engages the bearing shoulder 23 of the tool housing. This is the condition illustrated in FIG. 10, with the tool mandrel functioning as the tubing hanger.

Should the forces created by the well pressure acting on the tool mandrel exceed the opposing forces tending to hold the tool mandrel down in the tube hanging position, the tool mandrel will move upward relative to the tool housing and to the latch 66*a*. When this upward movement occurs, a portion of the locking sleeve 81 moves behind or within the distal ends of the spring fingers 68*a* to prevent disengagement of the serrations 69 from the housing thread 22; and this upward movement is limited by engagement of the shoulder 84 with the lower ends of the spring fingers 68*a*. This is the condition illustrated in FIGS. 11 and 12; and this is the condition, similar to that described with respect to FIG. 3, wherein the apparatus locks in the well pressure.

Figure 2E:
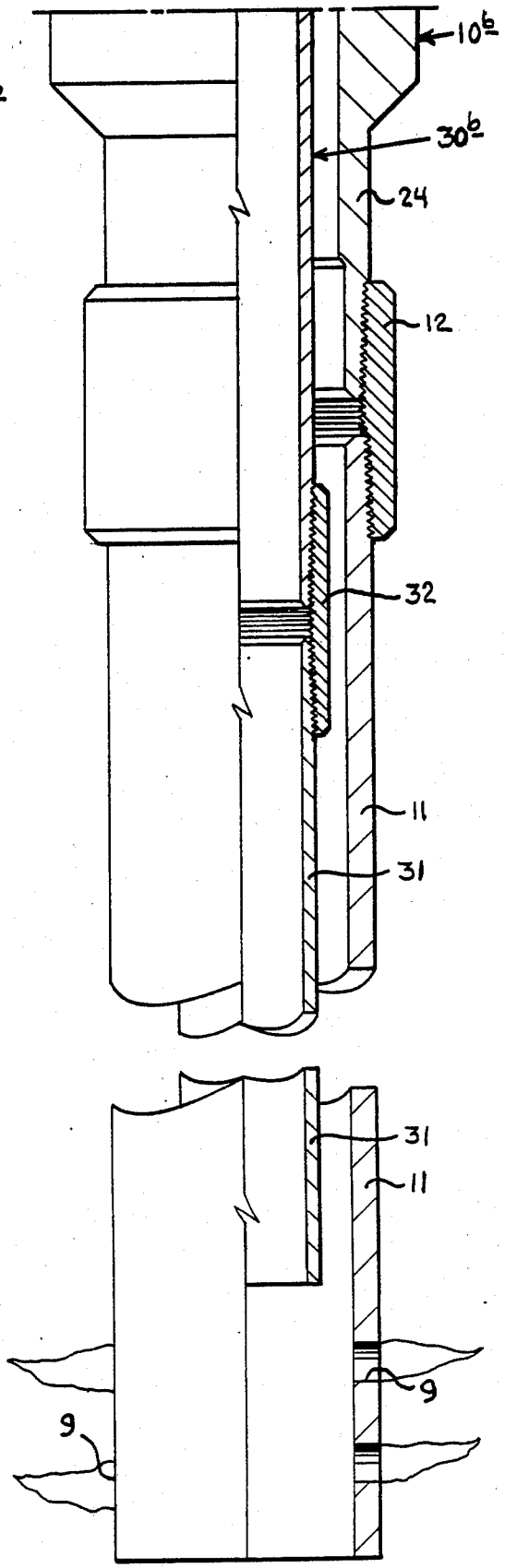

As with the embodiment of FIGS. 2E and 3, should it be desired to remove the tool mandrel from the tool housing, this is accomplished by right-hand rotation of the tool mandrel to unthread the coacting left-hand threads 22 and 69*a*. Since the threads may be binding, it is important that the rotational torque be applied to the spring fingers at the threaded ends; and this is accomplished in the configuration illustrated in FIGS. 10 through 12. As mentioned, the locking sleeve 81 is rotationally locked to the flutes 71, particularly for right-hand rotation of the tool mandrel; and through the coaction of the locking sleeve windows 83 and the spring fingers 68*a*, the unthreading torque is applied directly. This is an improvement of the structure illustrated in FIGS. 2D and 3 wherein this unthreaded torque is applied through the key pins 67, somewhat remote from the distal threaded ends of the spring fingers 68.

Method

The apparatus above described in one form of apparatus which may be used to practice a method for providing a one-way injection valve in the annulus between the casing string and the production tubing string of a producing well. The method may include one or more of the steps now described. A tubular tool housing member is provided with an upper interior polished bore and a lower interior locking profile, and this member is run into the well as a segment of the well casing string or as an independent tool housing anchored to the casing. Another tubular member, a tool mandrel, is run into the well casing as a segment of the production tubing string. The tubing segment is first provided with a plurality of circumferentially separated spacing flutes, to space the segment from the casing string and provide longitudinal flow paths therebetween, and to provide support for other components of the tubing segment. A tubular packing mandrel is supported on the flutes for carrying an external annular packing for sealing engagement with the polished bore of the casing segment. The lower end of this packing mandrel is provided with means defining an annular fixed valve seat. A tubular valve closure member is mounted in slidable relation on the tubing segment; and its upper end is provided with means defining an annular closure seat for sealing coaction with the fixed valve seat. Locking means are provided adjacent to the lower end of the tubing segment for coacting engagement with the locking profile of the casing segment, to limit axial movement of the tubing segment relative to the casing segment.

More detailed steps of the method may include those which follow. The valve closure member may be urged to sealing relation with the fixed valve seat by means of a valve closing spring. The casing segment and tubing segment may be provided with coacting bearing shoulders, as parts of the respective locking profile and locking means, to enable the apparatus to function as a tubing hanger. The casing segment may be provided with internal threads, and the tubing segment may be provided with latching spring fingers carrying external threads to provide a latch engageable by relative axial ratcheting movement and disengageable by relative rotational movement; the threads and latching fingers being parts of the respective locking profile and locking mechanism, with this structure functioning to limit upward movement of the tubing segment relative to the casing segment.

Operation, Features and Advantages

The principal purpose of the above-described apparatus and method is to provide a one-way injection valve for the injection of fluids into the well through the annulus between the casing string and the tubing string. In order for the injection fluid to pass the described valve, the pressure of the injection fluid within the annulus above the valve closure member 51 must exert a force sufficient to overcome the opposing forces, hence moving the valve closure member downward relative to the valve seat to open the valve. As discussed, the opposing forces include the force of the valve closure spring, which also serves as a buffer spring to minimize the effect of pressure surges, and the force acting on the lower face of the valve closure member 51 resulting from the well back pressure acting on the effective piston area of that closure member. The flow of injection fluid then may be controlled by varying the injection pressure in relation to the effective back pressure.

The described apparatus and method, in addition to providing the function of controlling the flow of an injection fluid, provide the functions of sealing the annulus, supporting the weight of the tubing string, and anchoring the tubing string against upward movement, which functions are frequently provided by a packer. Accordingly, the requirement of a packer may be eliminated in a well where this apparatus and method is used. More particularly, the coacting bearing shoulders of the casing segment and the tubing segment perform the weight supporting or tube hanging function. The described latching mechanism performs the function of limiting upward movement of the tubing string relative to the casing string; and the latching mechanism acting together with the one-way injection valve performs the function of preventing the well pressure from escaping through the annulus, that is maintaining the shut-in condition of the well.

A particular feature and advantage of the apparatus, resulting from the particular latching mechanism, is that the tubing segment may be set into, and latched with, the casing segment simply by axial lowering of the tubing string and tubing segment. When the tubing string reaches the limit position, determined by the coacting bearing shoulders, the apparatus is latched in place and is ready to function for all purposes.

Another particular feature and advantage of the apparatus, again resulting from the particular latching mechanism, is that the tubing string may be readily removed from the well merely by normal right-hand rotation of the string, this removal being effected by the provision of left-hand threads for the threads of the casing segment locking profile and the threads of the latch spring fingers.

While preferred embodiments of the invention have been illustrated and described, it will be understood by those skilled in the art that changes and modifications may be resorted to without departing from the spirit and scope of the invention. For example, the several sets of flutes may be replaced by other types of spacer members such as radial flanges provided with transverse ports or passages.

What is claimed is:

1. Injection fluid control apparatus, for use in a producing well which includes a string of casing and a string of production tubing, comprising a tool housing to be run into the well comprising a tubular member having a polished bore in one portion and having an internal locking profile in another portion;

a tool mandrel to be run into said casing comprising a tubular member having external, longitudinally spaced, spacer members to provide axial flow paths between said tool housing and said tool mandrel;

a tubular packing mandrel mounted on said spacer members carrying external annular packing means for sealing engagement with said polished bore of said tool housing; said packing mandrel having means at one end thereof defining an annular valve seat;

a tubular valve closure member mounted for axial sliding movement on said tool mandrel, having means at one end thereof defining an annular valve closure for coacting sealing engagement with said valve seat; said closure member carrying internal annular packing means for sealing engagement with said tool mandrel;

and locking means mounted on said tool mandrel for coacting engagement with said locking profile, to limit axial movement of said tool mandrel relative to said tool housing.

2. Apparatus as set forth in claim 1 wherein the improvement comprises means mounted on said tool mandrel for urging said valve closure member into sealing engagement with said valve seat.

3. Apparatus as set forth in claim 1 wherein the improvement comprises said locking profile including means defining an upward facing annular shoulder;

said locking means including means on one of said spacer members defining a downward facing annular shoulder;

said annular shoulders being configured for coacting engagement to effect support of said tool mandrel and its associated tubing string by said tool housing.

4. Apparatus as set forth in claim 1 wherein the improvement comprises a helical compression spring disposed to surround said tool mandrel, defining said urging means, and said spring being compressed between a fixed bearing ring means and said valve closure member, to maintain said closure member in sealing relation with said valve seat.

5. Apparatus as set forth in claim 1 wherein the improvement comprises said tool housing comprising a segment of the well casing; and said tool mandrel comprising a segment of the string of production tubing.

6. Apparatus as set forth in claim 1 wherein the improvement comprises said polished bore being provided in an upper portion of said tool housing, and said locking profile being provided in a lower portion of said tool housing;

said tubular packing mandrel being mounted on an upper portion of said tool mandrel, and said locking means of said tool mandrel being provided on a lower portion thereof.

7. Apparatus as set forth in claim 1 wherein the improvement comprises said spacer means comprising a plurality of longitudinally spaced sets of circumferentially spaced longitudinal flutes.

8. Apparatus as set forth in claim 7 wherein the improvement comprises said key means including an annular locking wall and a shoulder, positionable contiguous to the inner faces and ends of said threaded spring fingers, to maintain said finger threads in engagement with said housing threads.

9. Apparatus as set forth in claim 1 wherein the improvement comprises said locking profile including a length of internal annular threads;

said locking means including a tubular latch mounted on certain of said spacer members, carrying circumferentially spaced, flexible spring fingers; said spring fingers having external serrations, at the distal ends thereof, defining threads for coacting threaded engagement with said locking profile threads;

said locking profile and said spring fingers being configured relative to each other to effect engagement of said coacting threads by ratcheting action responsive to relative axial movement, and to effect disengagement of said coacting threads responsive to relative rotation.

10. Apparatus as set forth in claim 9 wherein the improvement comprises said locking means comprising a tubular guide mounted on said spacer members; said tubular latch being mounted on said tubular guide for relative axial movement, said guide having shoulder means for limiting axial movement of said latch in one direction;

and an annular locking cap mounted on said spacer members having shoulder means for limiting axial movement of said latch in the other direction; said locking cap disposed to prevent inward movement of the distal ends of said spring fingers, when said second shoulder means engages said latch to maintain said spring finger threads in threaded engagement with said threads of said locking profile.

11. Apparatus as set forth in claim 10 wherein the improvement comprises said tubular guide being provided with circumferentially spaced longitudinal slots; said tubular latch being keyed for rotation with said tubular guide by means of pins extending into said slots.

12. Apparatus as set forth in claim 9 wherein the improvement comprises said tubular latch being mounted for axial sliding movement relative to said tool mandrel;

key means for said latch comprising a tubular member fixed to said tool mandrel, having windows for confining circumferentially the distal threaded ends of said spring fingers, whereby unthreading torque is applied directly to said threaded ends.

13. A method for providing a one-way injection valve in the annulus between the production tubing and the casing of a producing well, comprising the steps running into the well a tubular tool housing having an interior polished bore and an interior locking profile;

running into said well casing, as a segment of said producing tubing, a tubular tool mandrel provided with external, longitudinally spaced spacer members;

mounting on certain of said spacer members a tubular packing mandrel for sealing engagement with the polished bore of said tool housing; providing at one end of said packing mandrel, means defining an annular valve seat;

mounting, in slidable sealing relation on said tool mandrel, a tubular valve closure member provided with means at one end defining a valve closure for sealing coaction with said valve seat;

mounting, on said tool mandrel, locking means for coacting engagement with said locking profile, to limit axial movement of said tool mandrel relative to said tool housing.

14. A method as set forth in claim 13 including the step urging said valve closure member, relative to said tool mandrel, toward said valve seat.

15. A method as set forth in claim 13 providing, as a part of said locking profile, an upward facing bearing shoulder;

providing, as a part of said locking means, a downward facing bearing shoulder defined by lower end faces of said spacer flutes;

and dimensioning said bearing shoulders for coacting engagement to effect the support of said tool mandrel by said tool housing.

16. A method as set forth in claim 13, providing, as a part of said locking profile, a length of internal threads;

providing, as a part of said locking means, circumferentially spaced spring fingers carrying external serrations defining threads for coaction with the threads of said latching profile;

mounting said spring fingers for ratcheting engagement with the threads of said latching profile through relative axial movement, and for disengagement from said profile threads through relative rotational movement.

* * * * *